US008722606B2

(12) United States Patent
Creamer et al.

(10) Patent No.: US 8,722,606 B2
(45) Date of Patent: May 13, 2014

(54) SCALE-REDUCING ADDITIVE FOR AUTOMATIC DISHWASHING SYSTEMS

(75) Inventors: Marianne Patricia Creamer, Warrington, PA (US); Joseph Manna, Quakertown, PA (US); Jan Edward Shulman, Newtown, PA (US)

(73) Assignee: Rohm and Haas Company, Philadelphia, PA (US)

( * ) Notice: Subject to any disclaimer, the term of this patent is extended or adjusted under 35 U.S.C. 154(b) by 97 days.

(21) Appl. No.: 12/932,834

(22) Filed: Mar. 8, 2011

(65) Prior Publication Data

US 2011/0224118 A1 Sep. 15, 2011

Related U.S. Application Data

(60) Provisional application No. 61/311,922, filed on Mar. 9, 2010.

(51) Int. Cl.
*C11D 3/60* (2006.01)

(52) U.S. Cl.
USPC ..... 510/230; 510/220

(58) Field of Classification Search
USPC ..... 510/230, 220
See application file for complete search history.

(56) References Cited

U.S. PATENT DOCUMENTS

| | | | | |
|---|---|---|---|---|
| 5,294,686 | A * | 3/1994 | Fiarman et al. | 526/233 |
| 5,308,532 | A | 5/1994 | Adler et al. | |
| 5,413,731 | A * | 5/1995 | Adler et al. | 510/230 |
| 5,858,944 | A * | 1/1999 | Keenan et al. | 510/223 |
| 5,968,884 | A | 10/1999 | Gopalkrishnan et al. | |
| 2007/0219110 | A1* | 9/2007 | Becker et al. | 510/392 |
| 2008/0261849 | A1 | 10/2008 | Preuschen et al. | |
| 2009/0305934 | A1* | 12/2009 | Creamer et al. | 510/221 |
| 2009/0306266 | A1* | 12/2009 | Creamer et al. | 524/425 |
| 2010/0160203 | A1* | 6/2010 | Seebeck et al. | 510/220 |
| 2010/0167975 | A1* | 7/2010 | Vandermeulen et al. | 510/230 |
| 2010/0275396 | A1* | 11/2010 | Nakano et al. | 15/104.93 |
| 2010/0292122 | A1* | 11/2010 | Tsumori et al. | 510/309 |
| 2010/0294309 | A1* | 11/2010 | Tropsch | 134/18 |

FOREIGN PATENT DOCUMENTS

| | | | |
|---|---|---|---|
| EP | 0116930 | A1 | 8/1984 |
| EP | 1721962 | A1 | 11/2006 |
| EP | 1721962 | B1 | 8/2008 |
| WO | 9629386 | A1 | 9/1996 |
| WO | 2006029806 | A1 | 3/2006 |
| WO | 2007025944 | A1 | 3/2007 |
| WO | 2007025955 | A1 | 3/2007 |
| WO | 2008017620 | A1 | 2/2008 |
| WO | 2008132133 | A1 | 11/2008 |
| WO | WO 2008132133 | * | 11/2008 |
| WO | 2009060966 | A1 | 5/2009 |
| WO | 2009123322 | A1 | 10/2009 |

* cited by examiner

*Primary Examiner* — Nicole M Buie-Hatcher
*Assistant Examiner* — M. Reza Asdjodi
(74) *Attorney, Agent, or Firm* — Kenneth Crimaldi

(57) ABSTRACT

An automatic dishwashing detergent composition having at least two components. The first component is a polymer containing polymerized residues of at least one $C_3$-$C_6$ carboxylic acid monomer and a hydroxy end group. The second component is a biodegradable builder selected from among nitrilotriacetic acid, ethylenediaminetetraacetic acid, diethylenetriaminepentaacetic acid, glycine-N,N-diacetic acid, methylglycine-N,N-diacetic acid, 2-hydroxyethyliminodiacetic acid, glutamic acid-N,N-diacetic acid, 3-hydroxy-2,2'-iminodisuccinate, S,S-ethylenediaminedisuccinate aspartic acid-diacetic acid, N,N'-ethylenediamine disuccinic acid, iminodisuccinic acid, aspartic acid, aspartic acid-N,N-diacetate, beta-alaninediacetic acid, polyaspartic acid, salts thereof and combinations thereof.

4 Claims, No Drawings

SCALE-REDUCING ADDITIVE FOR AUTOMATIC DISHWASHING SYSTEMS

This application claims priority to U.S. Provisional Application No. 61/311,922 filed Mar. 9, 2010, the disclosure of which is incorporated herein in its entirety by this reference.

BACKGROUND

This invention relates generally to a formulation that minimizes mixed inorganic deposits in non-phosphate or low-phosphate automatic dishwashing systems.

Automatic dishwashing detergents are generally recognized as a class of detergent compositions distinct from those used for fabric washing or water treatment. Automatic dishwashing detergents are required to produce a spotless and film-free appearance on washed items after a complete cleaning cycle. Phosphate-free or low-phosphate compositions rely on non-phosphate builders, such as salts of citrate, carbonate, silicate, disilicate, bicarbonate, aminocarboxylates and others to sequester calcium and magnesium from hard water, and upon drying, can leave an insoluble visible deposit. Polymers made from (meth)acrylic acid and maleic acid are known for use in inhibiting the scale or other insoluble deposits produced from non-phosphate builders. For example, WO 2009/123322 discloses polymers made from acrylic acid, maleic acid and a sulfonated monomer in a composition containing biodegradable builders. However, this reference does not disclose the compositions of this invention.

The problem addressed by this invention is to find a composition capable of reducing formation of mixed inorganic deposits.

STATEMENT OF INVENTION

The present invention is directed to an automatic dishwashing detergent composition comprising: (a) a polymer comprising polymerized residues of at least one $C_3$-$C_6$ carboxylic acid monomer and a hydroxy end group; and (b) a biodegradable builder selected from the group consisting of nitrilotriacetic acid, ethylenediaminetetraacetic acid, diethylenetriaminepentaacetic acid, glycine-N,N-diacetic acid, methylglycine-N,N-diacetic acid, 2-hydroxyethyliminodiacetic acid, glutamic acid-N,N-diacetic acid, 3-hydroxy-2,2'-iminodisuccinate, S,S-ethylenediaminedisuccinate aspartic acid-diacetic acid, N,N'-ethylenediamine disuccinic acid, iminodisuccinic acid, aspartic acid, aspartic acid-N,N-diacetate, beta-alaninediacetic acid, polyaspartic acid, salts thereof and combinations thereof; wherein the polymer of part (a) has less than 5 mole % sulfonic acid monomers.

DETAILED DESCRIPTION

All percentages are weight percentages (wt %), unless otherwise indicated and all temperatures are in ° C., unless otherwise indicated. Weight average molecular weights, $M_w$, are measured by gel permeation chromatography (GPC) using polyacrylic acid standards, as is known in the art. The techniques of GPC are discussed in detail in Modern Size Exclusion Chromatography, W. W. Yau, J. J. Kirkland, D. D. Bly; Wiley-Interscience, 1979, and in A Guide to Materials Characterization and Chemical Analysis, J. P. Sibilia; VCH, 1988, p. 81-84. The molecular weights reported herein are in units of daltons. As used herein the term "(meth)acrylic" refers to acrylic or methacrylic. Preferably, the biodegradable builders are present as sodium, potassium or lithium salts; preferably sodium or potassium; preferably sodium. Preferred biodegradable builders include glycine-N,N-diacetic acid, methylglycine-N,N-diacetic acid, 2-hydroxyethyliminodiacetic acid, polyaspartic acid, iminodisuccinic acid, 3-hydroxy-2,2'-iminodisuccinate, glutamic acid-N,N-diacetic acid and salts thereof. Preferably, the composition is "phosphorus-free," i.e., it contains less than 0.5 wt % phosphorus (as elemental phosphorus), alternatively less than 0.2 wt %, alternatively less than 0.1 wt %, alternatively no detectable phosphorus. Preferably, the composition is "low-phosphate," i.e., it contains from 0.5 to 3 wt % phosphorus (as elemental phosphorus), preferably from 0.5 to 1.5 wt %. Preferably, the composition contains less than 2 wt % of low-molecular weight (less than 1,000) phosphonate compounds (e.g., 1-hydroxyethylidene-1,1-diphosphonic acid (HEDP), and salts), preferably less than 1 wt %, preferably less than 0.5 wt %, preferably less than 0.2 wt %, preferably less than 0.1 wt %. A "$C_3$-$C_6$ carboxylic acid monomer" is a mono-ethylenically unsaturated compound having one or two carboxylic acid groups, e.g., (meth)acrylic acid, maleic acid, fumaric acid, itaconic acid, maleic anhydride, crotonic acid, etc. Preferably, the polymer comprises at least 50 wt % polymerized residues of at least one $C_3$-$C_6$ carboxylic acid monomer, preferably at least 60 wt %, preferably at least 70 wt %, preferably at least 80 wt %, preferably at least 85 wt %, preferably at least 90 wt %, preferably at least 95 wt %, preferably at least 98 wt %, preferably at least 99 wt %. Preferably, the $C_3$-$C_6$ carboxylic acid monomer is a $C_3$-$C_4$ carboxylic acid monomer, preferably one selected from among (meth)acrylic acid and maleic acid; preferably the $C_3$-$C_6$ carboxylic acid monomer comprises methacrylic acid, acrylic acid and maleic acid.

Preferably, the polymer comprises 55-80 wt % acrylic acid, 10-30 wt % methacrylic acid and 5-20 wt % maleic acid; preferably 60-75 wt % acrylic acid, 15-25 wt % methacrylic acid and 7-15 wt % maleic acid; preferably 65-72 wt % acrylic acid, 15-25 wt % methacrylic acid and 8-13 wt % maleic acid.

Preferably, the hydroxy end group is one produced by polymerizing the constituent monomers using an initiator comprising hydrogen peroxide. When produced by this method, the polymer would be expected to have polymer chains with sulfate end groups as well as those having hydroxy end groups.

A "sulfonic acid monomer" is one having a carbon-carbon double bond and a sulfonic acid or alkali metal or ammonium salts thereof. Preferably, the polymer contains less than 3 mole % of sulfonic acid monomers, preferably less than 2 mole %, preferably less than 1 mole %, preferably less than 0.5 mole %, preferably less than 0.1 mole %. Sulfonic acid monomers include sulfonic acrylic monomers, e.g., 2-acrylamido-2-methylpropanesulfonic acid (AMPS), allyloxybenzenesulfonic acid, methallylsulfonic acid and (meth)allyloxy benzenesulfonic acid, and salts thereof.

Other polymerized monomer residues which may be present in the polymer include, e.g., non-ionic (meth)acrylate esters, cationic monomers, monounsaturated dicarboxylates, saturated (meth)acrylamides, vinyl esters, vinyl amides (including, e.g., N-vinylpyrrolidone), sulfonated monomers, styrene and α-methylstyrene.

The total weight of biodegradable builders in the composition is from 2 to 40 wt % of the total weight of the composition. Preferably, total weight of biodegradable builders is at least 5 wt %, preferably at least 7 wt %, preferably at least 8 wt %, preferably at least 9 wt %, preferably at least 10 wt %. Preferably, the total weight of biodegradable builders is no more than 35 wt %, preferably no more than 30 wt %, preferably no more than 25 wt %, preferably no more than 20 wt %, preferably no more than 17 wt %, preferably no more than 15 wt %, preferably no more than 14 wt %, preferably no more than 13 wt %, preferably no more than 12 wt %. Preferably, the composition further comprises an alkali metal citrate, carbonate, bicarbonate and/or aminocarboxylate. Preferably, the amount of alkali metal citrate is from 0.01 to 40 wt %, preferably no more than 35 wt %, preferably no more than 30 wt %, preferably no more than 25 wt %, preferably no more than 20 wt %.

Preferably, the polymer contains no more than 40 wt % polymerized residues of esters of acrylic or methacrylic acid, preferably no more than 30 wt %, preferably no more than 20 wt %, preferably no more than 10 wt %, preferably no more than 5 wt %, preferably no more than 2 wt %, preferably no more than 1 wt %, preferably no more than 0.5 wt %. Preferably, the polymer comprises at least 70 wt % polymerized residues of monomers selected from (meth)acrylic acid and maleic acid, and no more than 30 wt % polymerized residues of esters of acrylic or methacrylic acid; preferably at least 80 wt % polymerized residues of monomers selected from (meth)acrylic acid and maleic acid, and no more than 20 wt % polymerized residues of esters of acrylic or methacrylic acid.

Preferably, the polymer has $M_w$ from 1,000 to 90,000. Preferably, $M_w$ is at least 2,000, preferably at least 3,000, preferably at least 5,000, preferably at least 7,000, preferably at least 10,000. Preferably, $M_w$ is no more than 70,000, preferably no more than 50,000, preferably no more than 40,000, preferably no more than 30,000, preferably no more than 20,000.

The polymer may be used in combination with other polymers useful for controlling insoluble deposits in automatic dishwashers, including, e.g, polymers comprising combinations of residues of acrylic acid, methacrylic acid, maleic acid or other diacid monomers, esters of acrylic or methacrylic acid including polyethylene glycol esters, olefin monomers, styrene monomers, AMPS and other sulfonic acid monomers, and substituted acrylamides or methacrylamides.

The polymer of this invention may be produced by any of the known techniques for polymerization of acrylic monomers, e.g., solution polymerization and emulsion polymerization; solution polymerization is preferred. Preferably, the initiator does not contain phosphorus. Preferably, the polymer contains less than 1 wt % phosphorus, preferably less than 0.5 wt %, preferably less than 0.1 wt %, preferably the polymer contains no phosphorus. The polymer may be in the form of a water-soluble solution polymer, slurry, dried powder, or granules or other solid forms.

Other components of the automatic dishwashing detergent composition may include, e.g., surfactants, oxygen and/or chlorine bleaches, bleach activators, enzymes, foam suppressants, colors, fragrances, antibacterial agents and fillers. Typical surfactant levels depend on the particular surfactant used, typically from 0.1 wt % to 10 wt %, preferably from 0.5 wt % to 5 wt %. Fillers in tablets or powders are inert, water-soluble substances, typically sodium or potassium salts, e.g., sodium or potassium sulfate and/or chloride, and typically are present in amounts ranging from 0 wt % to 75 wt %, preferably from 5% to 50%, preferably from 10% to 40%. Fillers in gel formulations may include those mentioned above and also water. Fragrances, dyes, foam suppressants, corrosion inhibitors, enzymes and antibacterial agents usually total no more than 5 wt % of the composition.

Preferably, the composition contains from 5 to 20 wt % of a percarbonate salt, preferably from 7 to 15 wt %, preferably from 8 to 13 wt %. Preferably, the composition has a pH (at 1 wt % in water) of at least 9, preferably at least 10.5; preferably the pH is no greater than 12.5, preferably no greater than 11.5.

Preferably, the composition contains no more than 38 wt % total carbonates (i.e., carbonate, bicarbonate and percarbonate), preferably no more than 36 wt %, preferably no more than 34 wt %, preferably no more than 32 wt %; and at least 12 wt % citrate, preferably at least 14 wt %, preferably at least 16 wt %, preferably at least 18 wt %; preferably total carbonates are at least 25 wt % and citrate is no more than 25 wt %. Preferably, the composition contains at least 2 wt % silicates (e.g., silicate, disilicate), preferably at least 4 wt %, preferably at least 6 wt %, preferably at least 8 wt %.

The composition can be formulated in any typical form, e.g., as a tablet, powder, monodose, multi-component monodose, sachet, paste, liquid or gel. The composition can be used under typical operating conditions for any typical automatic dishwasher. Typical water temperatures during the washing process preferably are from 20° C. to 85° C., preferably from 30° C. to 70° C. Typical concentrations for the composition as a percentage of total liquid in the dishwasher preferably are from 0.1 to 1 wt %, preferably from 0.2 to 0.7 wt %. With selection of an appropriate product form and addition time, the composition may be present in the prewash, main wash, penultimate rinse, final rinse, or any combination of these cycles. The polymer of the present invention can be formulated in a number of ways in the dishwashing detergent. For example, the polymer could be formulated with the inorganic builders, biodegradable builders, fillers, surfactants, bleaches, enzymes, and so forth. Alternatively, for example, the polymer could be formulated with the surfactant, citric acid, solvents, and other optional ingredients. Additionally, the polymer could be located in one or more compartments within an engineered unit dose product so as to release at a different point during the wash cycle than the biodegradable builder.

Preferably, the composition comprises from 0.5 to 12 wt % of said polymer. Preferably, the composition comprises at least 1 wt % of the polymer, preferably at least 1.5 wt %, preferably at least 2 wt %, preferably at least 2.5 wt %. Preferably, the composition comprises no more than 10 wt % of the polymer, preferably no more than 8 wt %, preferably no more than 6 wt %, preferably no more than 5 wt %, preferably no more than 4 wt %. Polymers of this invention may be blended with polymers made from sulfonic acid monomers.

EXAMPLES

Polymer Synthesis

Synthesis of Comparative Polymer C—To a two liter round bottom flask, equipped with a mechanical stirrer, heating mantle, thermocouple, condenser and inlets for the addition of monomer, initiator and chain regulator was charged 38 grams maleic anhydride and 345 grams deionized water. The mixture was set to stir and heated to 72° C. (+/−2° C.). In the meantime, a monomer solution of 315 grams glacial acrylic acid and 90 grams methacrylic acid was added to a graduated cylinder, thoroughly mixed for addition to the flask. An initiator solution of 12.4 grams sodium persulfate was dissolved in 45 grams deionized water and added to a syringe for addition to the kettle. A chain regulator solution of 27 grams sodium metabisulfite dissolved in 67.5 grams deionized water was added to a syringe for addition to the kettle. A chain regulator pre-charge solution was prepared by dissolving 1.08 grams sodium metabisulfite in 8 grams deionized water and set aside. A promoter solution of 5.81 grams of a 0.15% iron sulfate heptahydrate solution was added to a vial and set aside. Once the kettle contents reached reaction temperature of 72° C., the promoter solution was added, followed by the sodium metabisulfite pre-charge solution. After the reaction temperature recovered to 72° C., the monomer, initiator and chain regulator solutions were begun. The monomer feed was added over 90 minutes, chain regulator cofeed added over 80 minutes and initiator cofeed added over 95 minutes at 72° C.

At the completion of the feeds, 8 grams deionized water was added to the monomer feed vessel, as rinse. The reaction was held for 15 minutes at 72° C. In the meantime, the chaser solutions of 0.68 grams sodium metabisulfite and 15 grams deionized water was mixed and set aside, and 0.68 grams sodium persulfate and 15 grams deionized water was mixed and set aside.

At the completion of the hold, the above solutions were added linearly over 5 minutes and held for 15 minutes at 72° C. The chaser solution preps were repeated and added to the kettle over 5 minutes, followed by a 15 minute hold.

At the completion of the final hold, cooling was begun with the addition of 80 grams of deionized water. At 50° C. or below a solution of 420 grams of 50% sodium hydroxide was added to an addition funnel and slowly added to the kettle, controlling the exotherm to keep the temperature below 65° C. The funnel was then rinsed with 20 grams deionized water. Finally, 6 grams of a scavenger solution of 35% hydrogen peroxide was added to the kettle. The reaction was then cooled and packaged.

The final polymer had a solids content of 40.0% (as measured in a forced draft oven at 150° C. for 60 minutes). pH of the solution was 5.3 and final molecular weight ($M_w$) as measured by Gel Permeation Chromatography was 16622. This polymer has sulfate/sulfonate end groups.

Synthesis of Polymer A—To a two liter round bottom flask, equipped with a mechanical stirrer, heating mantle, thermocouple, condenser and inlets for the addition of monomers and initiator and was charged 175 grams deionized water. The mixture was set to stir and heated to 92° C. (+/−2° C.). In the meantime, a monomer solution of 210 grams glacial acrylic acid and 60 grams methacrylic acid was added to a graduated cylinder, thoroughly mixed for addition to the flask. A sodium maleate cofeed was prepared by adding 25.3 grams maleic anhydride mixed with 64.9 grams deionized water, to which 41.2 grams 50% sodium hydroxide was added. The solution was added to a graduated cylinder for addition to the kettle. An initiator solution of 13.2 grams sodium persulfate and 24.0 grams 35% hydrogen peroxide was dissolved in 40 grams deionized water, then added to a syringe for addition to the kettle. An initiator pre-charge solution of 3.6 grams of sodium persulfate and 4.0 grams of 35% hydrogen peroxide mixed with 5 grams of deionized water was set aside. A promoter solution of 26.64 grams of a 0.15% iron sulfate heptahydrate solution was added to a vial and set aside.

Once the kettle contents reached reaction temperature of 90° C., the promoter solution was added. When the temperature returned to 91° C., the initiator re-charge was added. One minutes after peak exotherm, the cofeed solutions were started. The maleate solution was added over 70 minutes, monomer and initiator cofeeds were added over 90 minutes.

At the completion of the feeds, 4 grams deionized water was added to the monomer feed vessel, as rinse. The reaction was held for 15 minutes at 91° C. In the meantime, the chaser solution of 1.6 grams of sodium persulfate and 15 grams of deionized water was mixed and set aside.

At the completion of the hold, the chaser solution was added linearly over 10 minutes and held for 15 minutes at 91° C. The chaser solution preps were repeated and added to the kettle over 5 minutes, followed by a 20 minute hold.

At the completion of the hold, 25 grams deionized water was added to the kettle and the reaction was then cooled to 70° C. At 70° C., a solution of 80 grams of 50% sodium hydroxide was added to an addition funnel and slowly added to the kettle over 30 minutes, 20 grams deionized water was added as a rinse. The pH of the kettle was >5, so a maleic acid scavenger solution of 10 grams sodium metabisulfite and 25 grams deionized water was added over 5 minutes and held for 2 minutes. Then an additional 30 grams of 50% solution of sodium hydroxide was added to the kettle. The contents was checked with sulfite test strips for a positive sulfite reading, as another maleic acid scavenger solution of 5 grams sodium metabisulfite and 12 grams deionized water was added to the kettle as a shot (temperature exotherm of 5° C. was noted). An additional 30 grams of 50% solution of sodium hydroxide was added to the kettle. Another maleic acid scavenger solution of 5 grams sodium metabisulfite and 12 grams deionized water was added to the kettle as a shot. A slight positive reading for residual sulfite was achieved, so the final sulfite scavenger solution of 2 grams of 35% hydrogen peroxide. The final dilution of 45 grams deionized water was added to the kettle and then cooled and packaged.

The final polymer had a solids content of 41.4% (as measured in a forced draft oven at 150° C. for 60 minutes). pH of the solution was 5.4 and final molecular weight as measured by Gel Permeation Chromatography was 26607.

Synthesis of Polymer B—The above process was repeated with the following changes. An initiator solution of 18.7 grams sodium persulfate and 41.2 grams 35% hydrogen peroxide was dissolved in 40 grams deionized water, then added to a syringe for addition to the kettle. An initiator pre-charge solution of 4.1 grams of sodium persulfate and 6.9 grams of 35% hydrogen peroxide mixed with 5 grams of deionized water was set aside. A promoter solution of 33.3 grams of a 0.15% iron sulfate heptahydrate solution was added to a vial and set aside.

At the completion of the hold, 45 grams deionized water was added to the kettle and the reaction was then cooled to 70° C. At 70° C., a solution of 80 grams of 50% sodium hydroxide was added to an addition funnel and slowly added to the kettle over 30 minutes, 20 grams deionized water was added as a rinse. The pH of the kettle was >5, so a maleic acid scavenger solution of 10 grams sodium metabisulfite and 25 grams deionized water was added over 5 minutes and held for 2 minutes. Then an additional 30 grams of 50% solution of sodium hydroxide was added to the kettle. The contents was checked with sulfite test strips for a positive sulfite reading, as another maleic acid scavenger solution of 5 grams sodium metabisulfite and 12 grams deionized water was added to the kettle as a shot (temperature exotherm of 5° C. was noted). The pH and residual sulfite was re-checked and an additional 30 grams of 50% solution of sodium hydroxide was added to the kettle. Another maleic acid scavenger solution of 5 grams sodium metabisulfite and 12 grams deionized water was added to the kettle as a shot. A slight positive reading for residual sulfite was achieved, so the final sulfite scavenger solution of 6 grams of 35% hydrogen peroxide was added. The reaction was then cooled and packaged.

The final polymer had a solids content of 40.6% (as measured in a forced draft oven at 150° C. for 60 minutes). pH of the solution was 5.4 and final molecular weight as measured by Gel Permeation Chromatography was 15174.

Comparative polymers A and B are polymers that do not have hydroxy end groups.

Polymer Testing—

All polymers were tested for scale reduction by incorporating them at 2.5 wt % (based on polymer solids) as described below and washing glasses for 5 cycles in a KENMORE QUIETGUARD dishwasher (solids added to main wash cycle) using water with 400 ppm hardness (2:1 $Ca^{+2}$:$Mg^{+2}$) at 130° F. (54.4° C.) with no food soil. Glasses were evaluated after 1, 3 and 5 cycles using the scale from ASTM method 3556-85 (1=clean, 5=heavy film).

| Description | Non-Phosphate ADW 1A | 1B | 1C | 1D | 1E | 1F |
|---|---|---|---|---|---|---|
| Sodium Citrate | 20.00% | 20.00% | 10.00% | 10.00% | 20.00% | 20.00% |
| TRILON M (40%) | 0.00% | 0.00% | 10.00% | 10.00% | 10.00% | 10.00% |
| Sodium Carbonate | 20.00% | 20.00% | 20.00% | 20.00% | 10.00% | 10.00% |
| Sodium Bicarbonate | 10.00% | 10.00% | 10.00% | 10.00% | 10.00% | 10.00% |
| Disilicate (BRITESIL H20) | 0.00% | 10.00% | 0.00% | 10.00% | 0.00% | 10.00% |
| Percarbonate | 10.00% | 10.00% | 10.00% | 10.00% | 10.00% | 10.00% |
| TERGITOL L-61 | 1.50% | 1.50% | 1.50% | 1.50% | 1.50% | 1.50% |
| Polymer (TBD) | 2.50% | 2.50% | 2.50% | 2.50% | 2.50% | 2.50% |
| Sodium Sulfate | 36.00% | 26.00% | 36.00% | 26.00% | 36.00% | 26.00% |
| | 100.00% | 100.00% | 100.00% | 100.00% | 100.00% | 100.00% |

Effect of Polycarboxylates on Filming Inhibition (Prototype 1A—ADW Powder w/o ABB, No Silicate)

| | No Polymer | Comp. Poly. B | Comp. Poly. A | Comp. Poly. C | Polymer A | Polymer B |
|---|---|---|---|---|---|---|
| 1 cycle | 2.1 | 1.5 | 1.9 | 1.8 | 1.6 | 1.7 |
| 3 cycles | 4.2 | 4.6 | 1.8 | 1.9 | 2 | 1.9 |
| 5 cycles | 5 | 5 | 1.6 | 2.1 | 2.7 | 2.2 |

Effect of Polycarboxylates on Filming Inhibition (Prototype 1B—ADW Powder w/o ABB, w/Silicate)

| | No Polymer | Comp. Poly. B | Comp. Poly. A | Comp. Poly. C | Polymer A | Polymer B |
|---|---|---|---|---|---|---|
| 1 cycle | 2.2 | 1.9 | 1.1 | 1.2 | 1.3 | 1.2 |
| 3 cycles | 4.2 | 4.7 | 2.1 | 2.3 | 2 | 1.9 |
| 5 cycles | 5 | 5 | 1.8 | 2.8 | 2.5 | 2.9 |

Effect of Polycarboxylates on Filming Inhibition (Prototype 1C—ADW Powder w/ABB, No Silicate)

| | No Polymer | Comp. Poly. B | Comp. Poly. A | Comp. Poly. C | Polymer A | Polymer B |
|---|---|---|---|---|---|---|
| 1 cycle | 2.4 | 1.7 | 1.4 | 1.6 | 1.7 | 1.5 |
| 3 cycles | 3.8 | 2 | 1.5 | 1.7 | 1.5 | 1.4 |
| 5 cycles | 5 | 2.4 | 1.9 | 2 | 1.8 | 1.7 |

Effect of Polycarboxylates on Filming Inhibition (Prototype 1D—ADW Powder w/ABB, w/Silicate)

| | No Polymer | Comp. Poly. B | Comp. Poly. A | Comp. Poly. C | Polymer A | Polymer B |
|---|---|---|---|---|---|---|
| 1 cycle | 1.5 | 1.4 | 1.3 | 1.4 | 1.5 | 1.4 |
| 3 cycles | 2.4 | 1.8 | 1.9 | 1.7 | 1.7 | 1.6 |
| 5 cycles | 4.2 | 3.7 | 1.9 | 2.1 | 1.7 | 2 |

Effect of Polycarboxylates on Filming Inhibition (Prototype 1E—ADW Powder w/ABB, No Silicate, Lower Soda Ash)

| | No Polymer | Comp. Poly. B | Comp. Poly. A | Comp. Poly. C | Polymer A | Polymer B |
|---|---|---|---|---|---|---|
| 1 cycle | 1.9 | 1.7 | 1.3 | 1.4 | 1.4 | 1.3 |
| 3 cycles | 3.1 | 1.9 | 1.6 | 1.8 | 1.8 | 1.5 |
| 5 cycles | 4.2 | 2.2 | 1.9 | 1.9 | 1.9 | 2.1 |

Effect of Polycarboxylates on Filming Inhibition (Prototype 1F—ADW Powder w/ABB, w/Silicate, Lower Soda Ash)

| | No Polymer | Comp. Poly. B | Comp. Poly. A | Comp. Poly. C | Polymer A | Polymer B |
|---|---|---|---|---|---|---|
| 1 cycle | 1.3 | 1.2 | 1.4 | 1.6 | 1.2 | 1.3 |
| 3 cycles | 2.6 | 1.5 | 1.4 | 1.8 | 1.3 | 1.3 |
| 5 cycles | 4.8 | 1.6 | 1.4 | 1.7 | 1.2 | 1.2 |

TRILON M is an aqueous solution of the trisodium salt of methylglycinediacetic acid (Na3MGDA), available from BASF Corp.

Polymer Samples:

Comparative polymer A ($M_w$=2220)=90% acrylic acid/10% maleic acid, sodium salt with a phosphono end group.

Comparative polymer B ($M_w$ 21,000)=70% acrylic acid/30% 2-acrylamido-2-methyl-1-propane sulfonic acid, sodium salt with a sulfonate end group.

Comparative polymer C=initiator wt %=6.24% sodium metabisulfite/2.76% sodium persulfate; weight %=70% acrylic acid/20% methacrylic acid/10% maleic acid; $M_w$=16,622

Polymer A=initiator wt %=5.6% sodium persulfate (NaPS)/3.2%; $H_2O_2$; Weight %=70% acrylic acid/20% methacrylic acid/10% maleic acid; $M_w$=26,607

Polymer B=initiator wt %=7.6% NaPS/5.6% $H_2O_2$; Weight %=70% acrylic acid/20% methacrylic acid/10% maleic acid; $M_w$=15,174

The invention claimed is:

1. An automatic dishwashing detergent composition comprising:

(a) from 2-8 wt % of a polymer comprising a hydroxy end group and polymerized residues of $C_3$-$C_6$ carboxylic acid monomers, which comprise:

(i) 65-72 weight % acrylic acid, (ii) 15-25 weight % methacrylic acid, and (iii) 8-13 weight % maleic acid, wherein the total of the weight percents of said polymerized residues of monomers (i), (ii) and (iii) is at least 99 weight percent of said polymer, based on the total weight of the polymer, and wherein said polymer (a) comprises no polymerized derivatives of aminoacrylol, alkoxylate or ethoxylate monomers; and (b) at least 5 weight %, and no more than 20 weight % of a biodegradable builder selected from the group consisting of glycine-N,N-diacetic acid, methylglycine-N,N-diacetic acid, glutamic acid-N,N-diacetic acid, salts thereof and combinations thereof;

wherein the polymer has less than 5 mole % sulfonic acid monomer and the detergent composition comprises less than 0.5 wt % phosphorus; and wherein the detergent composition comprises at least 6 wt % silicates and no more than 34 wt % total carbonates.

2. The composition of claim 1 in which the polymer has Mw from 5,000 to no greater than 20,000.

3. The composition of claim 2 in which the polymer has less than 1 mole % sulfonic acid monomer residues.

4. The composition of claim 3 in which the polymer has Mw from 10,000 to no greater than 20,000.

* * * * *